US005447292A

United States Patent [19]

Bouttement et al.

[11] Patent Number: 5,447,292

[45] Date of Patent: Sep. 5, 1995

[54] METHOD FOR THE INJECTION OF A PLUGGING MASS IN A TAPPING HOLE OF A METALLURGICAL REACTOR, SUCH AS A BLAST FURNACE

[75] Inventors: Jean-Luc Bouttement, Dunkerque; Henri Farda, Condettes; Harold Graber, Broukerque; Jacques Menuge, Verlinct Hun, all of France

[73] Assignee: Terres Refractaires Du Boulonnais, Neufchatel-Hardelot, France

[21] Appl. No.: 128,677

[22] Filed: Sep. 30, 1993

[30] Foreign Application Priority Data

Sep. 30, 1992 [FR] France ..... 92 11782

[51] Int. Cl.[6] ..... B22D 15/00

[52] U.S. Cl. ..... 266/45; 501/130

[58] Field of Search ..... 266/45, 271, 272, 273, 266/280; 501/95, 128, 129, 130

[56] References Cited

U.S. PATENT DOCUMENTS

| | | | |
|---|---|---|---|
| 3,607,809 | 9/1971 | Elby | 266/280 |
| 3,770,867 | 11/1973 | Criss | 501/129 |
| 4,276,091 | 6/1981 | Cassens, Jr. | 501/129 |

FOREIGN PATENT DOCUMENTS

| | | |
|---|---|---|
| 60-24306 | 2/1985 | Japan . |
| 63-161105 | 7/1988 | Japan . |
| 2-25509 | 1/1990 | Japan . |
| 3115512 | 5/1991 | Japan . |

OTHER PUBLICATIONS

A. Dufour et al. "Renue de Metallurgie" vol. 89, No. 1, Jan. 1992, Paris, France, pp. 37–44.

T. Yamamoto et al. "Iron and Steel Engineer", $Al_2O_3$ mud to decrease blast furnace tapping frequency, vol. 67, No. 6, Jun. 1990, Pittsburg, Pa., pp. 56–61.

*Primary Examiner*—Scott Kastler

*Attorney, Agent, or Firm*—Young & Thompson

[57] ABSTRACT

This method comprises injecting a first primary plugging mass (4), mixed with a binder, having given composition and physico-chemical properties, and allowing this primary mass to thermically solidify; after a baking of this primary mass, drilling a hole (8) of a given length and thereby achieving a degassing, and injecting in this hole a second plugging mass, termed secondary mass, having suitable composition and physico-chemical properties which is mixed with a binder and is more fluid than the primary mass and has a hardening speed lower than the hardening speed of the primary mass, so that the secondary mass can diffuse into cracks in the primary mass before solidifying. The secondary mass reinforces the zones of the primary mass which have been rendered fragile by microcracking, and thereby again provides a suitable length of the tapping hole.

6 Claims, 1 Drawing Sheet

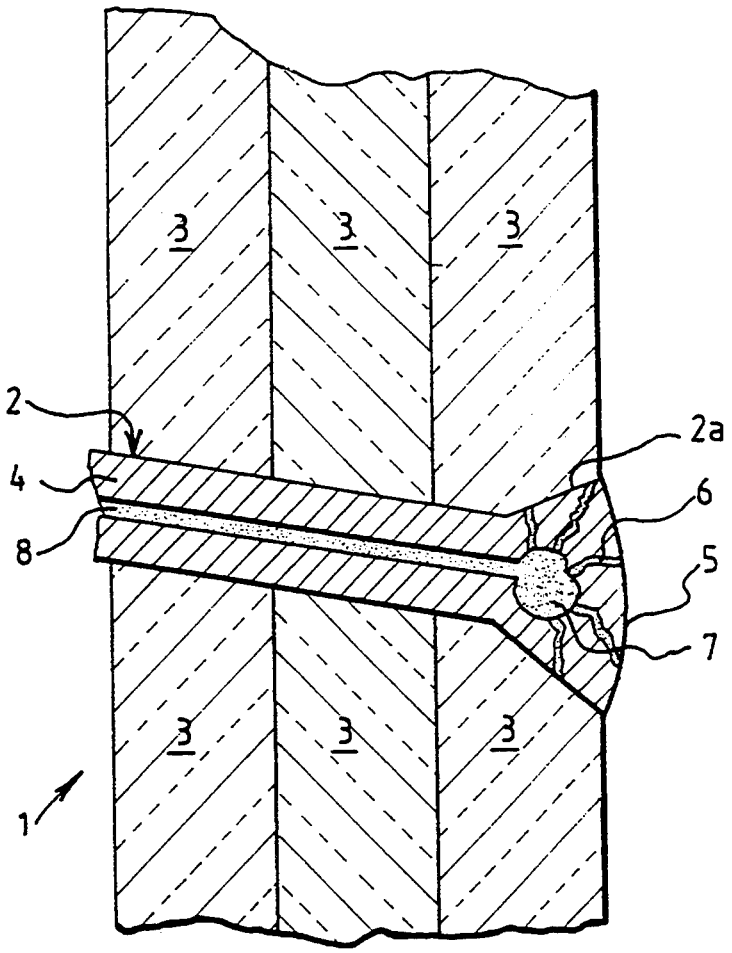
3
3
3
2
2a
4
6
8
5
7
3
3
3
1

METHOD FOR THE INJECTION OF A PLUGGING MASS IN A TAPPING HOLE OF A METALLURGICAL REACTOR, SUCH AS A BLAST FURNACE

The present invention relates to a method for the injection of a plugging mass in a tapping hole of a metallurgical reactor, such as a blast furnace, between two consecutive tappings.

As is known, the tapping holes of metallurgical reactors, such as blast furnaces, must be plugged between two consecutive tappings. The tapping hole of a blast furnace is delimited by carbon refractory blocks the entry of which progressively widens from the interior of the blast furnace during the life of the latter. For the purpose of plugging the tapping hole, it is known to inject therein a mass of given physico-chemical properties and plasticity.

Different types of plugging masses are known having variable compositions of mineral elements associated with hydrocarbon binders.

During the periods between the tappings, the volatile substances contained in the plugging mass in grouping together cause the formation of cracks and gas pockets in the mass. Further, the cracking of the refractory blocks around the tapping hole causes the circulation of liquids in the cracks, and these liquids become infiltrated into the plugging mass and moreover result in erosion of its side located inside the blast furnace. The infiltrations of liquid iron in the cracks gradually fill the gas pockets and this encourages the outer "mushroom" of the plugging mass to come away.

Consequently, when the tapping hole is repaired it is practically no longer possible to go beyond the place of the iron which filled the gas pockets, and this results in a large reduction in the length of the tapping hole, for example from 3 m to 2.20 m. Consequently, the cold source is moved closer to the hot source and this accelerates the deterioration of the refractory unit.

Finally, the plugging methods employed heretofore have many exploitation drawbacks, in particular the following:

the mass is rendered fragile by cracking, formation of gas pockets subsequently filled with liquid metal, solidification of the mass before complete plugging of the tapping hole, lack of homogeneity of the refractory assembly owing to the cracks in the carbonaceous blocks, shortening of the tapping hole, spitting during the tapping of the liquid metal owing to the cracks in the refractory blocks (gas flames), deterioration of the outer side of the "cupboard" formed by the refractory assembly.

An object of the invention is therefore to provide a method for plugging a tapping hole by means of which the aforementioned drawbacks are practically eliminated.

According to the invention, the method for injecting a plugging mass in a tapping hole of a metallurgical reactor is characterized by the succession of the following steps:

a) injecting a first primary plugging mass mixed with a binder having given composition and physico-chemical properties, and allowing said primary mass to thermally solidify;

b) after the baking of said primary mass, drilling a hole of given length and in this way achieving a degassing, and injecting therein a second plugging mass, termed a secondary mass, of suitable composition and physico-chemical properties, which is mixed with a binder, is more fluid than the primary mass and has a slower baking speed than that of the primary mass so that the secondary mass can diffuse into the cracks of the primary mass before being solidified.

Owing to its high fluidity, the secondary mass diffuses through the cracks of the monolithic element constituted by the solidified primary mass, and thus plugs the cracking in course of development in the primary mass and in the outer "mushroom" of the tapping hole. In this way the wear of the plugging mass is substantially limited to its outer face.

In an alternative embodiment of the method according to the invention, after diffusion and solidification of the secondary mass, a hole of the same length as the preceding hole is again drilled in the secondary mass, and a fresh amount of secondary mass is injected therein so as to plug it.

This additional step provides a more reliable plugging of the tapping hole.

Further features and advantages of the invention will be apparent from the following description with reference to the accompanying drawing of one embodiment of the method according to the invention given as a non-limitative example.

BRIEF DESCRIPTION OF THE DRAWING

The single FIGURE is a vertical half-sectional half-elevational view, with parts cut away, of the wall of a metallurgical reactor surrounding its tapping hole and of the plugging mass of the latter.

The metallurgical reactor, such as a blast furnace, whose wall 1 defining its tapping hole 2 is partly shown in the drawing, comprises an assembly of refractory blocks 3 in juxtaposed relation around the tapping hole 2.

Between two tappings or pourings in the use of the reactor, the hole 2 is normally plugged by a mass 4 which is determined, on the inside of the reactor, by an enlarged portion 5, termed "mushroom" filling the divergent end 2*a* of the hole 2.

According to the prior art, cracks, such as 6, appear in the plugging mass 4 and especially in the mushroom 5. The cracks 6 lead to gas pockets, such as 7, which are formed during the solidification of the plugging mass 4 and are gradually filled with liquid metal (iron in the case of a blast furnace), as has been previously explained.

According to the invention, the plugging mass 4 is injected into the tapping hole 2 in accordance with the following steps:

a) A first primary plugging mass is injected which has given chemical composition and physico-chemical properties, adapted to the conditions of operation of the blast furnace. This primary mass is intimately mixed with suitable organic binder selected from among phenolic resins, tars, petroleum or vegetable oils, for example a phenolic resin, and allowed to thermally solidify.

The chemical analysis of the primary mass carried out on the calcinated product has for example the following general composition by weight:

| | |
|---|---|
| $Al_2O_2$ | 8 to 65% |
| $SiO_2 + Si_3N_4$ | 8 to 62% |

-continued

| | |
|---|---|
| SiC | 5 to 35% |
| $Fe_2O_3$ | 0.1 to 5% |
| MgO | 0.1 to 4.5% |

and more precisely the following composition:

| | |
|---|---|
| $Al_2O_3$ | 45.5% |
| $SiO_2 + Si_3N_4$ | 33.5% |
| SiC | 15% |
| $Fe_2O_3$ | 3.3% |
| MgO | 0.1% |

the balance being constituted by residual elements.

TABLE 1

| PRIMARY PLUGGING MASS | |
|---|---|
| Basic constituent | Bauxite |
| Type of binder | Organic |
| Maximum dimension of the particles in mm | 3 |
| Apparent volumic mass in kg/m$^3$ | 2210 |
| PHYSICAL PROPERTIES: measured on cylindrical specimens dia. 50 × 50 IN MEAN VALUES | |
| After baking at °C. | 800 |
| Apparent volumic mass kg/m$^3$ | 1930 |
| Resistance to compression MPa | 5.4 |
| % Open porosity | 32 |

This primary plugging mass has a coefficient of plasticity adapted to the conditions of use and to the power of the plugging devices.

In the course of its solidification, the volatile substances of this primary plugging mass gather together and form gas pockets, such as 7, after having travelled in the mass through microcracks, such as 6.

b) After the baking of the primary mass, a hole 8 of given length is drilled from the exterior of the reactor up to a gas pocket 7, which causes the degassing of the latter.

There is then injected into the hole 8 a second plugging mass, termed secondary mass, the chemical composition and the physico-chemical properties of which are those mentioned in the following Table 2 within the approximate limits of the ranges mentioned in this table.

The chemical analysis of the secondary mass carried out on the calcinated product has the following general composition by weight:

| | |
|---|---|
| $Al_2O_3$ | 35 to 65% |
| $SiO_2 + Si_3N_4$ | 20 to 40% |
| SiC | 0.1 to 30% |
| $Fe_2O_3$ | 0.2 to 4.5% |
| MgO | 0.1 to 3.5% |
| preferably | |
| $Al_2O_3$ | 40 to 58% |
| $SiO_2 + Si_3N_4$ | 20 to 35% |
| SiC | 0.1 to 30% |
| $Fe_2O_3$ | 0.2 to 4.5% |
| MgO | 0.1 to 3.5% |
| and for example | |
| $Al_2O_3$ | 52% |
| $SiO_2 + Si_3N_4$ | 29% |
| SiC | 16% |
| $Fe_2O_3$ | 2.6% |
| MgO | 0.2% |

the balance being constituted by residual elements.

TABLE 2

| SECONDARY PLUGGING MASS | |
|---|---|
| Basic constituent | White corundum |
| Type of binder | Organic |
| Maximum dimension of the particles in mm | 0.5 |
| Apparent volumic mass in kg/m$^3$ | 2150 |
| PHYSICAL PROPERTIES: measured on cylindrical specimens dia. 50 × 50 IN MEAN VALUES | |
| After baking at °C. | 800 |
| Apparent volumic mass kg/m$^3$ | 1750 |
| Resistance to compression MPa | 2.8 |
| % Open porosity | 38.5 |

The secondary mass has more than 95% particles the size of which is less than 500 μm. These particles are mixed with one or more organic binders the quantity of which represents more than 10% of the weight of the total mixture, the residue of this binder being after coking according to for example the ASTM standard D 2416 higher than 5%. This finer particle size imparts to the secondary mass a fluidity which is higher than that of the primary mass, this fluidity being characterized by a workability index higher than 20% at 20° C. measured for example according to the standard ASTM C 181. The secondary mass has a baking speed lower than that of the primary mass through which it diffuses by infiltrating into the cracks in course of formation and development in the primary mass 4 and in its mushroom 5, until its complete solidification. All of the cracks are then filled and the gas expelled therefrom.

In other words, the injection of a secondary mass which is more fluid than the primary mass reinforces the zones of the latter which were rendered fragile by the microcracking, the secondary mass having time to infiltrate into the microcracks of the primary mass owing to its low hardening speed and to its higher fluidity.

Consequently, the plugging mass is no longer deteriorated by the cracks, and the mushroom 5, which is no longer subjected to deterioration in its mass, consequently remains in position, only its outer side still undergoing an erosion.

After injection of the secondary mass, the plugging of the tapping hole 2 is in principle finished. However, for more safety, it is possible to proceed to a further drilling of a hole 8 with the same length as the preceding hole and to once more inject a suitable quantity of secondary mass which if required completes the action of the preceding secondary mass.

What is claimed is:

1. Method for injecting a plugging mass in a tapping hole of a metallurgical reactor, between two consecutive tappings for the use of the latter, comprising the succession of the following steps in combination:

a) injecting a first primary plugging mass, mixed with a binder, having a given composition and physico-chemical properties, and allowing said primary mass to thermally solidify, b) baking said primary mass, thereafter drilling a hole of a given length and thereby achieving a degassing, and injecting in said hole a secondary mass, which is mixed with a binder, is more fluid than said primary mass and has a hardening speed lower than the hardening speed of said primary mass so that said secondary mass can diffuse in cracks of said primary mass before solidifying.

2. Method according to claim 1, comprising baking said secondary mass after said diffusion thereof, thereafter again drilling in said secondary mass a second hole of the same length as the preceding hole, and injecting in said second hole a further quantity of secondary mass so as to plug said second hole.

3. A secondary plugging mass employed in a method for injecting a plugging mass in a tapping hole of a metallurgical reactor, between two consecutive tappings in the use of the reactor, said secondary plugging mass having particles the majority of which particles have a size of less than 500 μm, said particles being mixed with at least one organic binder the residue of which after coking is higher than 5%, said secondary plugging mass having the following general composition:

| | |
|---|---|
| $Al_2O_3$ | 35 to 65% |
| $SiO_2 + Si_3N_4$ | 20 to 40% |
| SiC | 0.1 to 30% |
| $Fe_2O_3$ | 0.2 to 4.5% |
| MgO | 0.1 to 3.5% |

the balance being constituted by residual elements.

4. Secondary plugging mass according to claim 3, having the following composition:

| | |
|---|---|
| $Al_2O_3$ | 40 to 58% |
| $SiO_2 + Si_3N_4$ | 20 to 35% |
| SiC | 0.1 to 30% |
| $Fe_2O_3$ | 0.2 to 4.5% |
| MgO | 0.1 to 3.5% |

The balance being constituted by residual elements.

5. A plugging mass in a tapping hole of a metallurgical reactor, said mass comprising a first primary plugging mass, mixed with a binder, said primary plugging mass being adapted to thermally solidify, and a central core within said primary plugging mass, said central core comprising a secondary mass, mixed with a binder, said secondary mass being more fluid than said primary mass and having a hardening speed lower than the hardening speed of said primary mass so that upon heating, said secondary mass can diffuse in cracks of said primary mass before solidifying.

6. A plugging mass as claimed in claim 5, wherein said secondary plugging mass has particles the majority of which particles have a size of less than 500 μm, said binder being an organic binder in such quantity that the binder has a residue after coking which is higher than 5% by weight of the secondary mass.

* * * * *